US005714701A

United States Patent [19]

Hsieh

[11] Patent Number: 5,714,701

[45] Date of Patent: Feb. 3, 1998

[54] CONNECTING MEANS INCORPORATED WITH A BASS DRUM

[76] Inventor: Wu-Hong Hsieh, No. 46, Lane 59, Chungcheng Rd., Luchou Hsiang, Taipei Hsien, Taiwan

[21] Appl. No.: 789,053

[22] Filed: Jan. 28, 1997

[51] Int. Cl.[6] ..... G10D 13/02

[52] U.S. Cl. ..... 84/422.1; 84/422.2

[58] Field of Search ..... 84/422.1, 422.2

[56] References Cited

U.S. PATENT DOCUMENTS 5,398,584 3/1995 Liao ..... 84/422.1

*Primary Examiner*—Michael L. Gellner
*Assistant Examiner*—Shih-yung Hsieh
*Attorney, Agent, or Firm*—Welsh & Katz, Ltd.

[57] ABSTRACT

A connecting means incorporated with a bass drum is able to adjust the height of a pedal, so that a user is able to readily adjust the height of the pedal as required to have a same acoustic effect with a same force exerted on the pedal.

8 Claims, 5 Drawing Sheets

CONNECTING MEANS INCORPORATED WITH A BASS DRUM

FIELD OF THE INVENTION

The present invention generally relates to a connecting means, and more particularly to a connecting means used in a bass drum, which is able to adjust travelling distance of a beater without changing any part of the drum.

BACKGROUND OF THE INVENTION

Bass drums can be called the soul of music, because they lead the music to places where people dreamed of and the states that stir up spirits. Therefore, while playing music, the volume of the bass drum should be considered with care and dedication. Generally, the volume of the bass drum is controlled by a user through stepping on a pedal a first end of which is suspended and securely connected to a periphery of a shaft which is pivotally connected between two posts. A first end of a resilient member is securely provided on one side of the posts and a second end thereof is securely connected to a base having a second end of the pedal pivotally connected thereon, so that a beater securely connected to the shaft will be swung back and forth every time the user steps on the pedal resulting in a pivoting action of the shaft.

To adjust to different spaces available for the bass drum and different tunes, a user often has different assembling seats to limit the travelling distance of the beater. The assembling seat mounted on the shaft is provided to limit travelling distance of the beater, thereby with the same stepping strength acted onto the pedal, a user may have different volume of the bass drum by using different assembling seats which regulate a movement of the beater. Although the acoustic effect of the bass drum does have dramatic changes by using different assembling seats and improves rhythm of sound, yet, carrying different assembling seats will increase the burden to the user and sometimes will even spoil a melody of a song if the choice of certain assembling seat is wrong. It is likely that a user will make a wrong choice of an assembling seat if the user keeps on using structures of assembling seats of herein before mentioned.

From the previous description, it is noted that many kinds of products sold in the market can not fulfill the requirements of a drum user and so there is a long and unfullfilled need for a connecting means for use in a bass drum and constructed in accordance with the present invention which tends to mitigate and/or obviate the aforementioned problems.

SUMMARY OF THE INVENTION

The main objective of the invention is to provide a connecting means used in a bass drum, which is able to be adjusted to various situations, such as different spaces available for the drum or different tunes and allow a beater of the bass drum to sound different volume.

In accordance with one aspect of the present invention, the connecting means of the invention comprises two side plates each having a plurality of first holes defined therein for threadingly receiving a plurality of first screws therethrough and a centrally defined through hole for securely receiving a shaft therethrough, a chain, a driven block and a driving block. The driven block is configured to have a plurality of teeth formed on an upper face thereof, a hole defined and configured to drivingly receive the shaft therethrough, a plurality of first screw holes defined to threadingly receive the first screws therein, an adjustable rod threadingly inserted therethrough, a rod integrally formed therewith, a second screw hole defined therein and communicating with the hole for threadingly receiving a retainer therein and a threaded hole defined on the upper face thereof for securely retaining the chain thereto with a second screw. The driving block is configured to have a socket defined therein for slidably receiving the rod therein, and a threaded bore defined therein for threadingly receiving the adjustable rod therein. An oblong slot is further defined in either one of the side plates and a bore is provided in the driving block and corresponding to the oblong slot, such that a retaining member is able to restrain the movement of the driving block.

Another objective of the invention is to provide a link having the driving block pivotally connected to a first end thereof such that an extension or a retraction of the adjustable rod from the driven block will also result in adjusting a travelling distance of a beater mounted onto an assembling seat.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
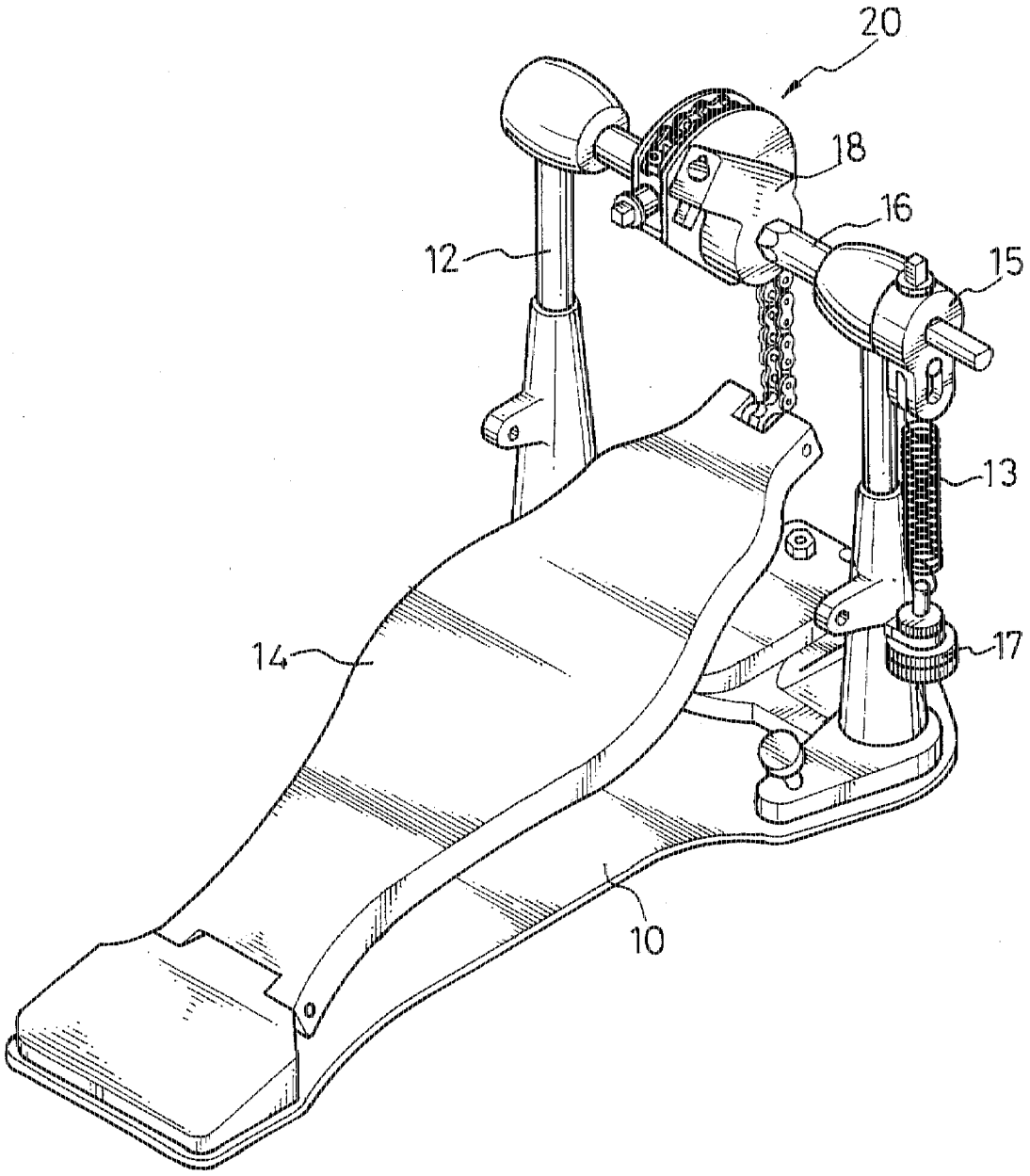
FIG. 1 is a perspective view of a connecting means mounted on a base having a pedal pivotally connected between the base and the connecting means.
Figure 2:
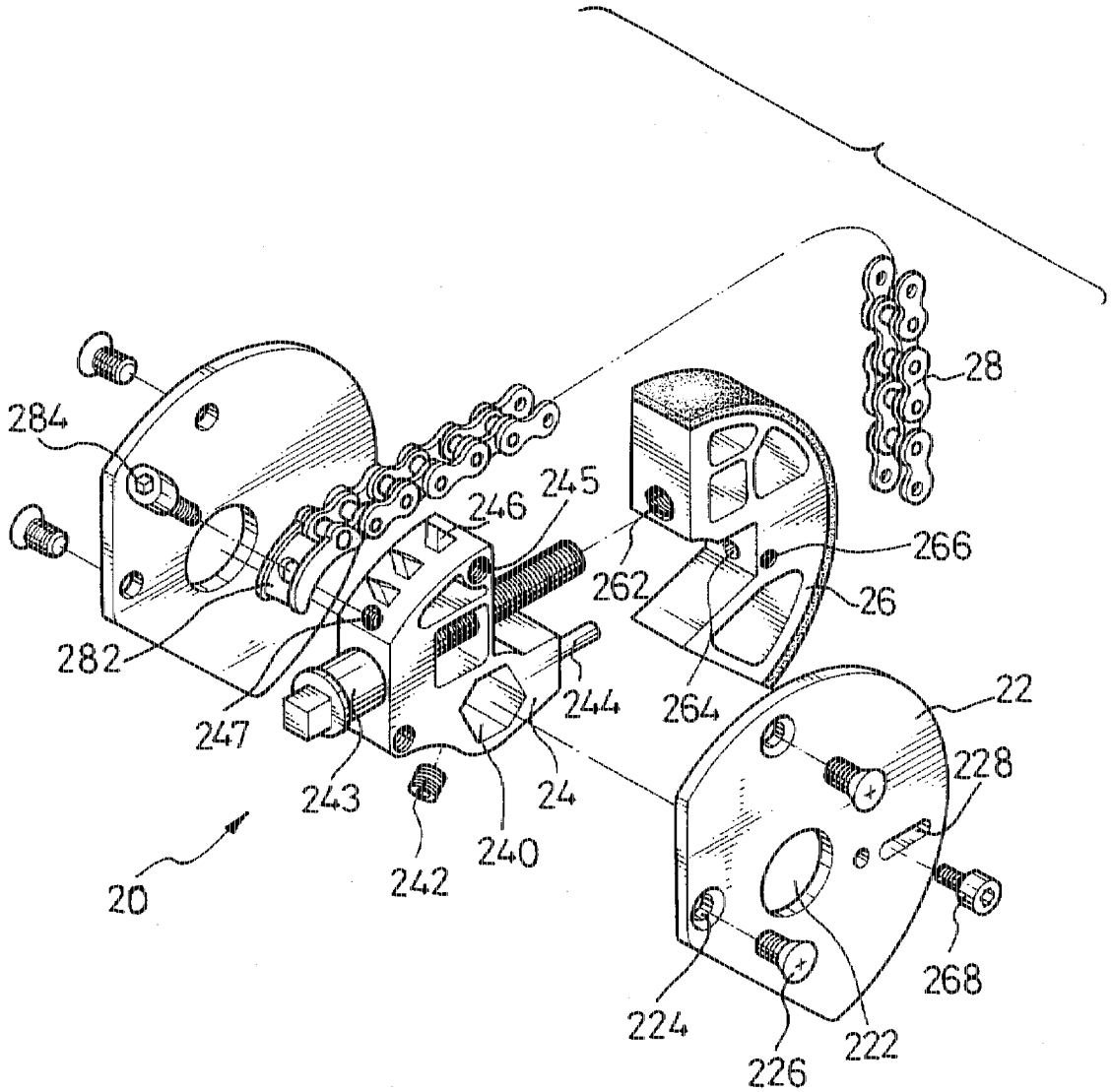
FIG. 2 an exploded view of the connecting means constructed in accordance with the present invention.

Referring to FIG. 1, a connecting means 20 mounted on a shaft 16 and constructed in accordance with the present invention is shown. The connecting means 20 is securely mounted onto a shaft 16 which is pivotally supported by two posts 12. The two posts 12 are fixedly connected with a base 10 having a first end (not numbered) of a pedal 14 pivotally connected thereto. A second end (not numbered) of the pedal 14 is securely connected with a chain 28 (as indicated in FIG. 2) which is rigidly secured on the connecting means 20. A first end of a resilient member 13 is securely connected to an end of an elongate block 15 which is securely connected with the shaft 16 and a second end thereof is securely connected to an adjustable member 17 which is able to adjust a length of the resilient member 13, such that the resilient member 13 will provide a certain amount of recovery force to the shaft 16 as required, whenever the pedal 14 is depressed.

Figure 3:
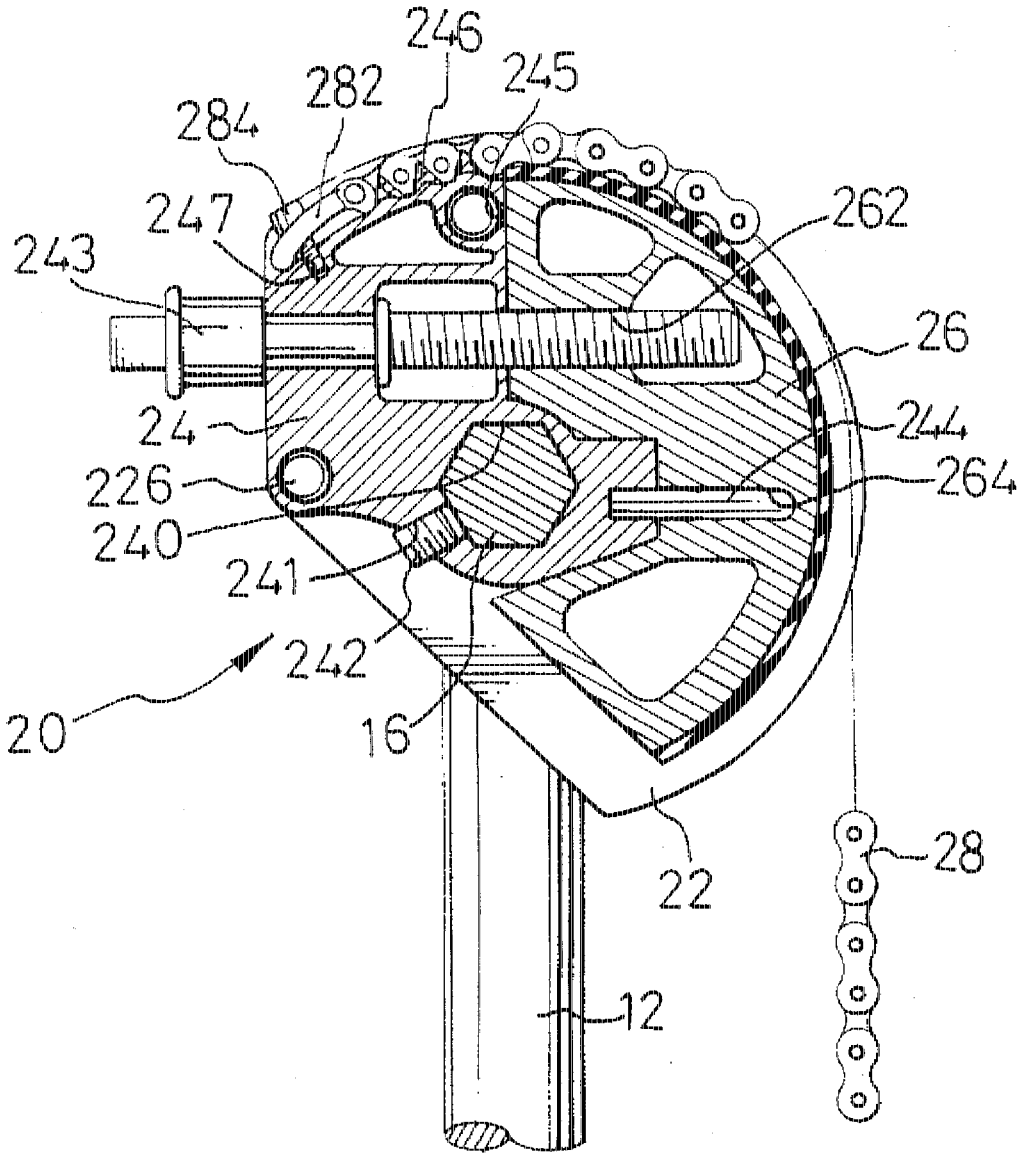
FIG. 3 is a partially cross sectional view of the connecting means.
Figure 4:
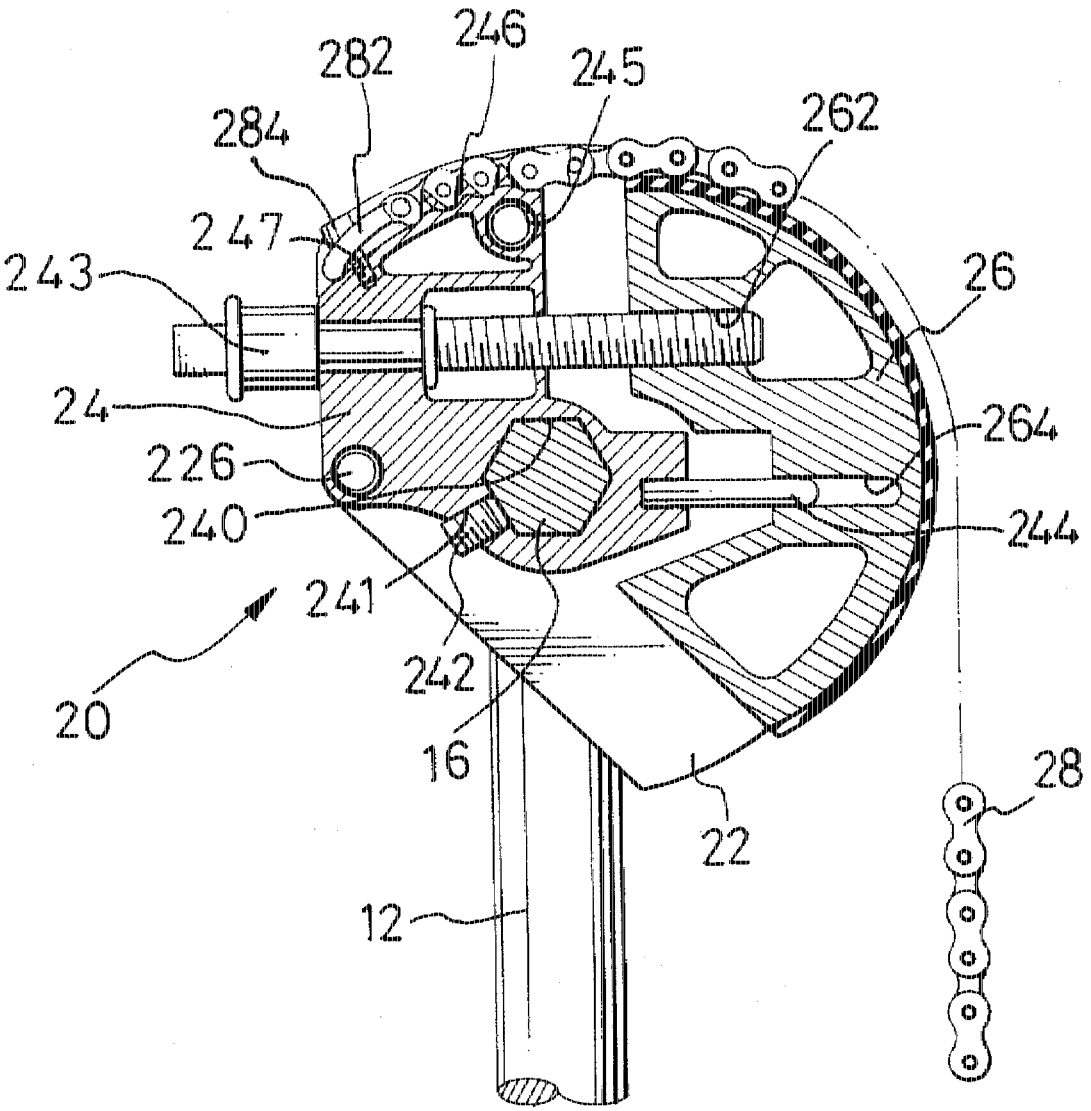
FIG. 4 is a schematic view of the connecting means showing movement of an adjustable rod and a driving block.

Referring to FIGS. 1 and 2, an assembling seat 18 having a blind hole (not numbered) defined therein for receiving a beater (not shown) therein is also mounted on the shaft 16. The connecting means 20 comprises two side plates 22 each having a plurality of first holes 224 defined therein for receiving a plurality of first screws 226 therethrough and a centrally defined through hole 222 for securely receiving the shaft 16 therethrough, a chain 28, a driven block 24 and a driving block 26. The driven block 24 is configured to have a plurality of teeth 246 formed on an upper face thereof, a hole 240 defined and configured to drivingly receive the shaft 16 therethrough, a plurality of first screw holes 245 defined to threadingly receive the first screws 226 therein, an adjustable rod 243 threadingly inserted therethrough, a rod 244 integrally formed therewith, a second screw hole 241 (as shown in FIG. 3) defined therein and communicating with the hole 240 for threadingly receiving a retainer 242 therein and a third screw hole 247 defined in the upper face thereof for threadingly receiving a second screw 284 therein. The second screw 284 extends through a plate 282 attached to the chain 28 and further extends into the third screw hole 247, such that the chain 28 is securely attached to the driven block 24. The driving block 26 is configured to have a socket 264 defined therein for slidably receiving the rod 244 therein, and a threaded bore 262 defined therein for threadingly receiving a first end of the adjustable rod 243. An oblong passage 228 is defined in either one of the side plates 22 and a fourth screw hole 266 is provided in the driving block 26 and corresponding to the oblong slot 228, such that a retaining member 268 extends through the oblong passage 228 to be threadedly received in the fourth screw hole 266, thus restraining the movement of the driving block 26.

When in use, the two side plates 22 are securely attached to either side of the driven block 24 by the first screws 226 and the driving block 26 is threadingly connected with the driven block 24 by the threaded insertion of the adjustable rod 243 into the threaded bore 262 and also the rod 244 is disposed within the socket 264 of the driving block 26. When the driven block 24 and the driving block 26 are combined together with the adjustable rod 243 and the rod 244, the chain 28 is then disposed on the upper face of the driven block 24 and the driving block 26 and is restrained by both the teeth 246 formed on the upper face of the driven block 24 and the plate 282 attached thereto.

Referring to FIGS. 2 and 3, it is noted that the shaft 16 is firstly and respectively inserted into one of the through holes 222 of the side plates 22, and the hole 240 of the driven block 24, then the other through hole 222 of the remaining side plate 22. The shaft 16 is further secured within the hole 240 of the driven block 24 by the threading insertion of the retainer 242 into the second screw hole 241, such that a distal tip of the retainer 242 urges against a side face of the shaft 16. Furthermore, when required, the adjustable rod 243 is able to be threadingly inserted into the threaded bore 262 of the driving block 26, so that the driving block 26 will be forced away from the driven block 24, which consequently will result in that a portion of the chain 28 originally disposed on the upper faces of both the driven block 24 and the driving block 26 is increased. Because the plate 282 of the chain 28 is fixedly secured on the upper face of the driven block 24, the movement of the driving block 26 will cause the pedal 14 securely connected with a second end of the chain 28 to tilt upward. Therefore, a user needs only a small force to step on the pedal 14 to have the same acoustic effect as the state before this adjustment. Otherwise, the user only needs to screw out a little the adjustable rod 243 to lengthen the chain 28 to have another kind of acoustic effect with the same force applied to the pedal 14.

Figure 5:
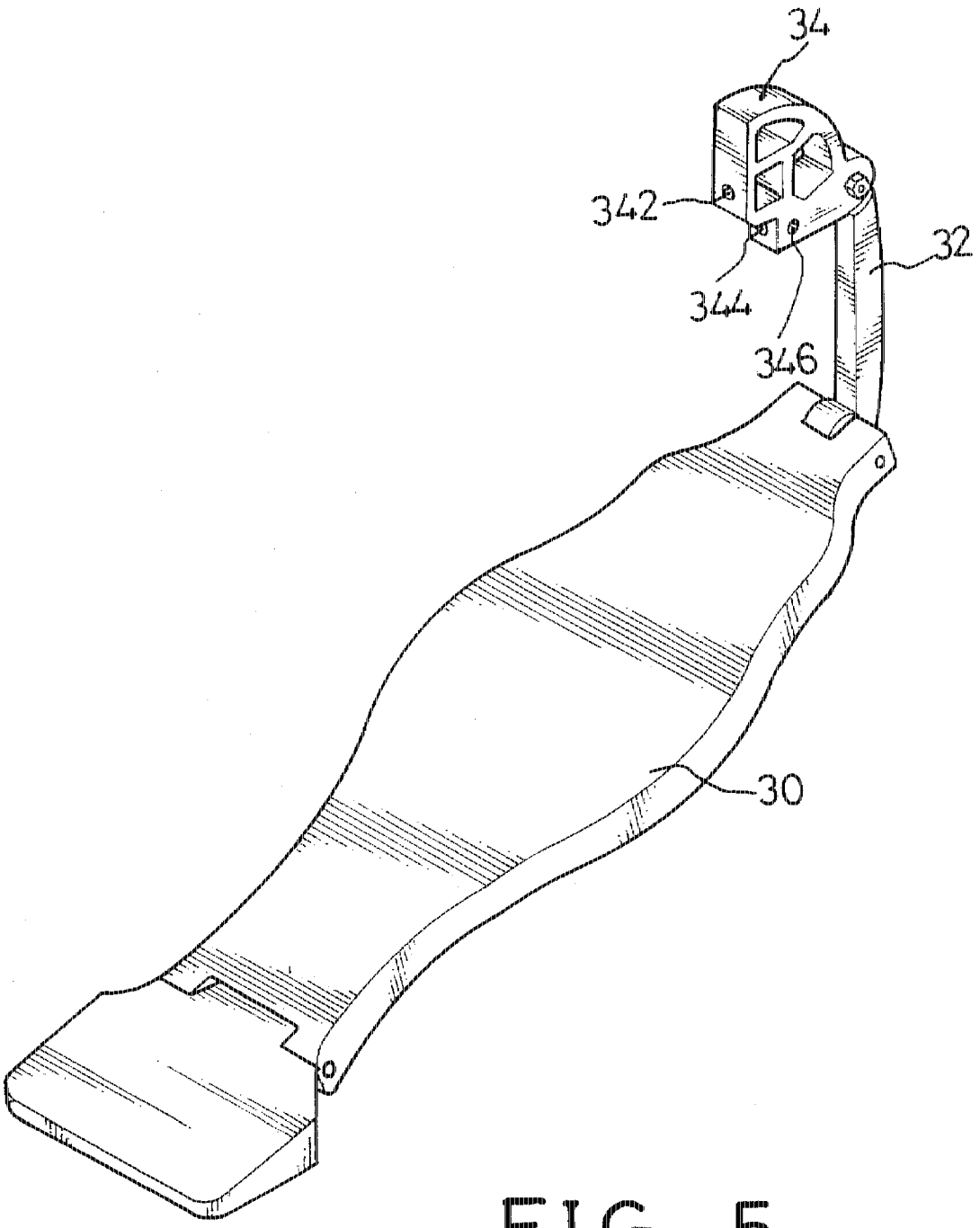
FIG. 5 is an embodiment of a pedal having the driving block pivotally connected thereto.

FIG. 5 shows another preferred embodiment of the present invention. A pedal 30 is provided to have a first end of a link 32 pivotally connected to a first end thereof, and a second end of the link 32 is provided with a mating block 34 pivotally connected thereto. The mating block 34 is configured to have a threaded bore 342, a socket 344 and a bore 346 defined therein, so that the driven block 24 securely mounted onto the shaft 16 is able to be mated with the mating block 34 via the adjusting rod 243 and the rod 244 as previously described.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A connecting means incorporated with a bass drum comprising:

a chain having a plate fixedly attached to a first tip thereof;

a driven block configured to have:

a plurality of teeth formed on an upper face thereof for restraining said chain;

a first hole defined therein;

a shaft fixedly received within said first hole;

an adjustable rod threadingly inserted therethrough;

a rod integrally formed therewith;

a second hole defined therein and communicating with said first hole;

a retainer threadingly received within said second hole and abutted said shaft within said hole; and a threaded hole defined on said upper face thereof for threadingly receiving a first screw therein to fixedly retain said plate of said chain thereon; and a driving block configured to have:

a socket defined therein for slidably receiving said rod of said driven block therein; and a threaded bore defined therein for threadingly receiving said adjustable rod therein.

2. The connecting means incorporated with a bass drum as claimed in claim 1 further comprising two side plates each configured to have a centrally defined through hole and a plurality of third holes corresponding to holes defined within said driven block, thereby allowing said shaft to be inserted into said through hole and said side plates securely connected with said driven block via second screws inserted into said third holes of said side plates and holes of said driven block.

3. The connecting means incorporated with a bass drum as claimed in claim 1, wherein said first hole of said driven block is configured to have the same shape as that of said shaft, so that said driven block will pivot with said shaft.

4. The connecting means incorporated with a bass drum as claimed in claim 2, wherein each of said side plates further have one oblong passage defined to correspond to a bore defined within said driving block, so that a retaining member is able to be treadingly inserted into said oblong passage and said bore and restrain a movement of said driving block.

5. A connecting means incorporated with a bass drum comprising:

a chain having a plate fixedly attached to a first tip thereof;

a link, a first end of which is pivotally connected with a pedal;

a driven block configured to have:

a plurality of teeth formed on an upper face thereof for restraining said chain;

a first hole defined therein;

a shaft fixedly received within said first hole;

an adjustable rod threadingly inserted therethrough;

a rod integrally formed therewith;

a second hole defined therein and communicating with said first hole;

a retainer threadingly received within said second hole and abutted said shaft within said first hole; and a threaded hole defined in said upper face thereof for threadingly receiving a first screw therein to fixedly retain said plate of said chain thereon;

a driving block pivotally connected with a second end of said link and configured to have:

a socket defined therein for slidably receiving said rod therein; and a threaded bore defined therein for threadingly receiving said adjustable rod therein.

6. The connecting means incorporated with a bass drum as claimed in claim 5 further comprising two side plates each configured to have a centrally defined through hole and a plurality of third holes corresponding to holes defined within said driven block, thereby allowing said shaft to be inserted into said through hole and said side plates securely connected with said driven block via second screws inserted into said third holes of said side plates and holes of said driven block.

7. The connecting means incorporated with a bass drum as claimed in claim 5, wherein said first hole of said driven block is configured to have the same shape as that of said shaft, so that said driven block will pivot with said shaft.

8. The connecting means incorporated with a bass drum as claimed in claim 6, wherein each of said side plates further have one oblong passage defined to correspond to a bore defined within said driving block, so that a retaining member is able to treadingly inserted into said oblong passage and said bore and to restrain a movement of said driving block.

* * * * *